United States Patent [19]

Bartesaghi

[11] 4,328,729

[45] May 11, 1982

[54] PLANE DIE-CUTTING MACHINE

[76] Inventor: Angelo Bartesaghi, Coduti a Fossoli 22, Lecco (Como), Italy

[21] Appl. No.: 146,619

[22] Filed: May 5, 1980

[30] Foreign Application Priority Data

May 14, 1979 [IT] Italy ..... 22655 A/79

[51] Int. Cl.[3] ..... B26F 1/00

[52] U.S. Cl. ..... 83/568; 83/569; 83/644; 83/646

[58] Field of Search ..... 83/510, 569, 568, 644–649

[56] References Cited

U.S. PATENT DOCUMENTS

| | | | |
|---|---|---|---|
| 1,487,219 | 3/1924 | Dreis | 83/644 X |
| 2,130,818 | 9/1938 | Soderberg | 83/646 X |
| 3,057,241 | 10/1962 | Chambon | 83/510 |
| 3,182,588 | 5/1965 | Bolliger | 83/510 X |
| 3,316,791 | 5/1967 | Greis et al. | 83/644 X |
| 3,777,608 | 12/1973 | Kopf | 83/646 X |
| 4,054,076 | 10/1977 | Kumabe | 83/644 |

*Primary Examiner*—James M. Meister

*Attorney, Agent, or Firm*—Lerner, David, Littenberg & Samuel

[57] ABSTRACT

A plane die-cutting machine, having a plane and fixed punch as well as a counter-punch with arch-shaped profile and apparatus to roll the counter-punch without any reciprocal sliding with respect to the punch, in order to die-cut each sheet of material under work in succession by the displacement of the theoretical line of contact of the counter-punch on the punch.

7 Claims, 5 Drawing Figures

PLANE DIE-CUTTING MACHINE

BACKGROUND OF THE INVENTION

1. Field of the Invention

This invention relates to a plane die-cutting machine designed for die-cutting laminar material, for instance, even if not exclusively, paper material. This machine includes, in a known way a punch equipped with protruding blades and/or points and a counter-punch, as well as means to reciprocally move the punch and the counter-punch perpendicularly to the die-cutting plane, in order to allow for the introduction of a sheet of material to be die-cut, and subsequently to press in a controlled way this sheet between the punch and the counter-punch, so to obtain a penetration of the blades and/or points into the material under work as far as desired.

2. Description of the Prior Art

Plane die-cutting machines of this type are well known and used.

They practically consist of a plane press, one of the elements of which, the punch, bears a series of blades or points, the position and orientation of which may be changed at will, while the other element consists of a plane plate which, when actuated, presses the laminar material against the punch, as far as to reach a stop that defines the degree of penetration of die-cutting blades and/or points. These machines of known type, specially when designed to perform the die-cutting operation on sheets of important size and made of material having a certain resistance to blade and/or point penetration, substantially show the disadvantage of requiring high pressures and forces. In particular, once the die-cutting necessary specific pressure has been established, the machine should be capable of developing a total force equivalent to the specific pressure multiplied the surface of the material to be die-cut at each die-cutting cycle. This involves the need of creating moving masses, particularly the counter-punch and the pieces connected to it, which must be considerably sturdy, such as to support the forces involved, and therefore correspondingly heavy. So, besides the need of having means producing the desired total die-cutting force, it is necessary to have means determining the reciprocal movement of punch and counter-punch as far as to allow for the substitution of the sheet of material under work, these means being necessarily sized and operating in relation to the entity of the moving masses which, as it has been said, is considerable. Therefore, this involves the study of particularly powerful and onerous motor means and the need of reducing the speed of said approaching and departing reciprocal movements of punch and counterpunch, in relation to the weight of the moving masses and to the consequent inertia of same.

SUMMARY OF THE INVENTION

Accordingly, an object of the present invention is to provide a new plane die-cutting machine of the above considered and defined type, which allows to perform the die-cutting operation considerably reducing the total forces as required and therefore the entity of the moving masses, with subsequent possibility of increasing the work speed, through keeping the die-cutting conditions unchanged and in particular keeping the die-cutting specific pressure unchanged.

Substantially, according to the invention, the above and further objects are achieved by a plane die-cutting machine, as defined above, wherein one of the pressing elements, consisting of punch and counter-punch, is plane and fixed, while the other one has a pressing external surface with an arch-shaped profile, and wherein moving and pressing reciprocal means press the second of said elements against the material under work and against the first element, in correspondence with a reduced and instantly and theoretically linear surface, which covers in succession the whole linear profile of the first element and the arch-shaped profile of the second element, by rolling the second profile on to the first one. In particular, for reasons of construction, it is advisable that the element with arch-shaped profile is constituted by the counter-punch, which therefore presents a pressing surface substantially consisting of an arc of cylindrical surface.

In this way, according to the invention, as the die-cutting force is exercised at any moment on an extremely reduced useful zone, it is possible to considerably reduce the machine potentiality without affecting die-cutting conditions and in particular without modifying the required die-cutting specific pressure. Consequently, since the forces to which the moving masses are submitted are considerably lower, it is possible to reduce the weight of same and therefore to correspondingly increase the machine work speed, in particular during the departing and approaching movements, before pressing, of the counter-punch in relation to the punch.

According to another advantageous feature of the invention, the counter-punch movements are controlled in correspondence with at least two points of same, placed on the opposite sides of the center line of its arch-shaped profile, these two points being moved perpendicularly to the die-cutting plane in an independent but coordinated way, in order to obtain said rolling motion of counter-punch profile on the punch profile. Advantageously, said movement is performed, for each point, by a connecting rod-crank unit, where the crank is formed by an adjustable eccentric turning around an axis and where the rotations of the two axes of the crank occur, thanks to a mechanical connection, at the same speed and in opposite directions, the cranks being relatively offset in relation to the angular wideness of the arch profile of the counter-punch and to the crank radius.

DESCRIPTION OF THE PREFERRED EMBODIMENT

Figure 1:
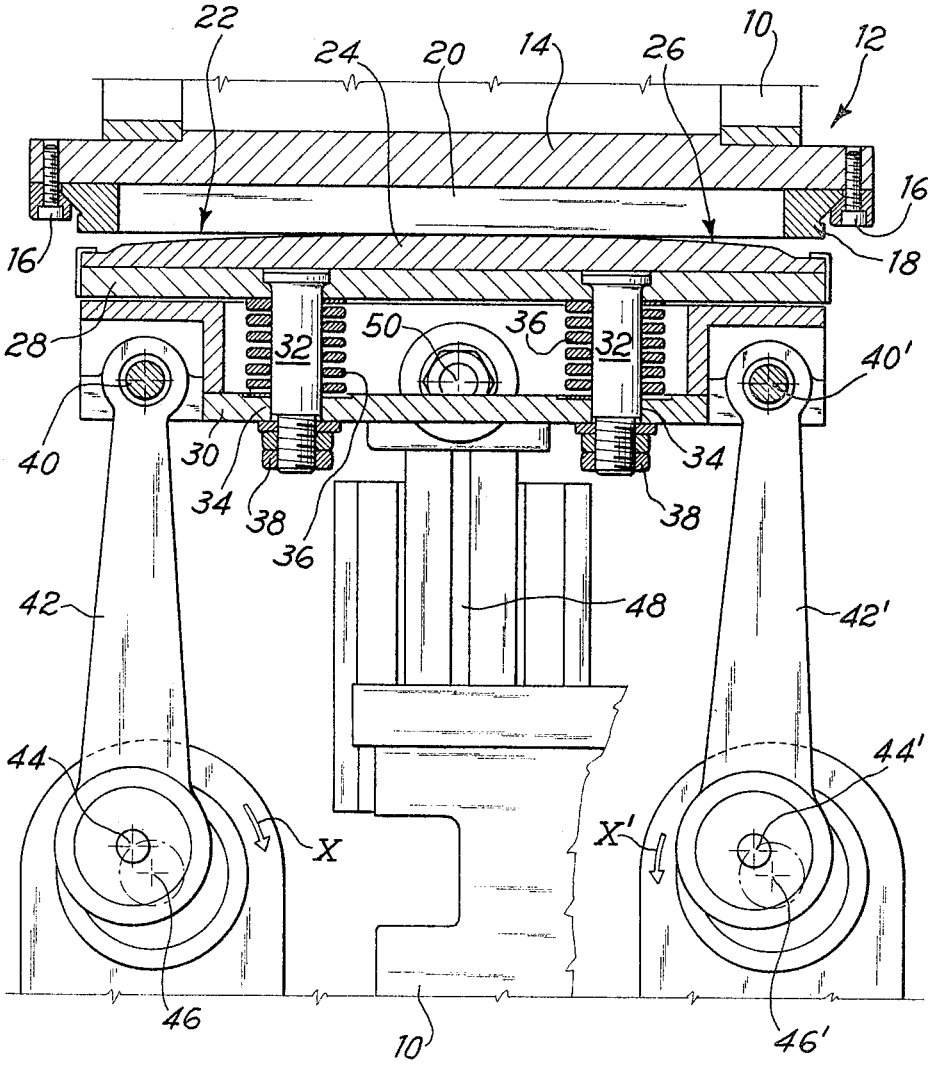
FIG. 1 is a partial cross section, perpendicular to the die-cutting plane, showing the machine main components in one of their possible working positions.

First of all with reference to FIG. 1, the machine includes, in a substantially known way, a supporting frame 10 supporting and holding in a fixed way a punch 12 substantially formed by a support 14, for instance of rectangular shape, to which a frame 18 is fixed by means of screws 16, said frame supporting and holding the punch 20 itself, which appears as a plane surface showing a series of blades and/or points for die-cutting (which are not represented in detail as they belong to the known technique). The punch 20 defines a substantially plane die-cutting surface, extending perpendicularly to the drawing plane, in correspondence with the line 22.

Said punch 20 is designed to work together with a counter-punch 24, substantially formed by a plate which has a pressing surface 26 which, according to the invention, has an arch-shaped profile, being constituted by a part of a cylindrical side surface. As it can be seen from the drawing, the surface 26 radius is very large, but however small enough to cause a neat shifting of the surface 26 from the horizontal line 22.

The counter-punch 24, which is mounted on a support 28, may be removed from the punch 20 to allow for the manual or automatic introduction of a sheet of laminar material between them. After this operation the counter-punch 24 approaches to the punch 20 and presses the laminar material against the latter so as to perform a die-cutting.

As it will be better seen later on, according to this invention, the counter-punch 24 is rolled with its arch-shaped surface 26 on the plane punch 20, in order to perform the die-cutting not simultaneously on the whole laminar material sheet inserted between the punch and the counter-punch, but in succession on different points of said sheet until the whole sheet is involved. More precisely, the operation is carried out in such a way as to put the surfaces 22 and 26 in correspondence with one of their ends, for instance the end on the right in the drawing, then rolling the surface 26 on the surface 22 until involvement in succession of the whole extension of both these surfaces and therefore of the laminar material sheet placed between them. Therefore, die-cutting occurs, at any moment, in correspondence with an extremely small zone which theoretically is constituted by a mere line of contact between the two surfaces, extending for the whole wideness of the punch and the counter-punch perpendicularly to the drawing plane. In practice, also considering the high radius of the surface 26, the contact surface is a real and fairly wide surface, but always considerably smaller than the surface concerned in the case of normal plane die-cutting with a plane counter-punch.

The reduction of forces allows to reduce not only the potentiality of the pressing means but also the weight of the moving masses, consisting of the counter-punch and the support 28 as well as of all that is connected to them, consequently reducing the potentiality of the means performing their displacements and increasing the speed of these movements.

Always referring to FIG. 1, the support 28 of the counter-punch 24 is housed in a frame 30 by means of mobile pivots inside holes 34 of said frame 30, with a contrast provoked by helical springs 36 and with movement limiting means in the form of nuts 38 screwed onto the threaded end of pivots 32. Therefore, the counter-punch may move in a limited way perpendicularly to the die-cutting plane (which can be defined by the surface 22 and extends perpendicularly to that of the drawing), to perform small adjustement displacements to the die-cutting conditions during this operation.

To control the rolling movements of counter-punch 24 on the surface 22, it is necessary to act on two points, integral or in any case connected to said counter-punch 24, placed symmetrically on the two sides of the symmetry plane of surface 26. Obviously this control may be double or triple, according to the extension of the counter-punch 24 perpendicularly to the drawing plane. As shown in FIG. 1, two connecting rods 42 and 42' are pivoted onto the frame 30, in correspondence with two opposite terminal zones of same and on pivots 40 and 40', these connecting rods 42 and 42' are in turn fixed, at their opposite ends, to pivots 44, 44' eccentrically mounted with respect to a rotation axis 46, 46', each group 40–46, 40'–46' defining therefore a connecting rod-crank unit, where the crank is defined by the excentric 44 or 44'. The crank radius, that is the eccentricity of pivots 44, 44', may be adjustable for an easier accomodation of the machine to any possible working condition.

In any case, the two axes 46, 46' are turned by a single motor (not shown) which actuates the same by means of a series of gears (not shown because easy to be determined by those skilled in the art), said gears causing a rotation of said axes 46, 46' at the same speed and towards opposite directions, as indicated by arrows X and X' of FIG. 1. As can be seen from the figure, the two eccentrics 44, 44', on the two sides of the counter-punch 24, are offset for a certain angle which can be calculated in relation to the crank radius and to the angular wideness of the arch-shaped surface 26. The control means also include a guide, formed for instance by a longitudinal groove 48, extending perpendicularly to the die-cutting plane, where a pivot 50 slides integral to the above mentioned frame 30, so as to ensure movements of the latter in a perpendicular direction with respect to said die-cutting plane.

Thanks to the above mentioned line-up of the connecting rod-crank controls and to the guide 48, 50, each point of the surface 26 of the counter-punch 24 is submitted to a movement perpendicular to the die-cutting plane, an approaching and a departing movement with respect to said plane and therefore with respect to the surface 22, the movement of each point being offset with respect to the movement of the points near to it, in such a way that each predetermined position of the surface 26 with respect to the surface 22 is reached, in different and subsequent times, from different and subsequent points of the same surface 26.

Figure 2:
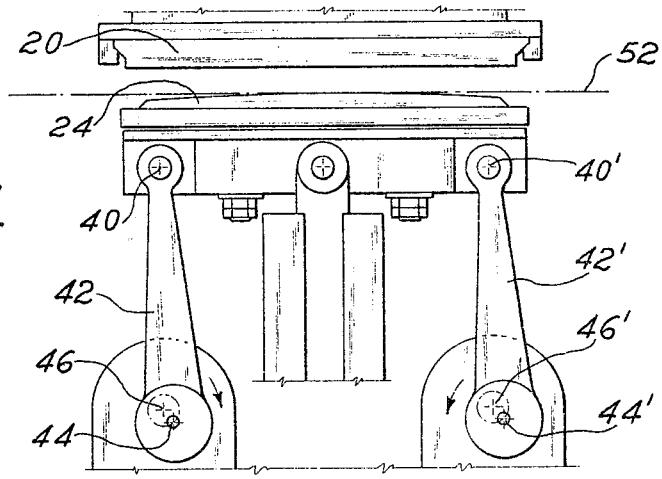
FIGS. 2, 3 and 4 are side views, always perpendicular to the die-cutting plane and in a reduced scale in comparison with that of FIG. 1, showing the same main components of the machine in three different and subsequent reciprocal working positions.

More in detail, when the eccentrics 44, 44' are near to their position of bottom dead center, the counter-punch 24 results to be detached from the punch 20 to allow for the substitution or the progress of the laminar material to be die-cut, schematically indicated by 52 in FIG. 2, which illustrates this working condition. More precisely, with reference to FIG. 2, it can be noticed that, while the eccentric 44 has not yet reached its position of bottom dead center, the eccentric 44' has already passed this position of bottom dead center and is therefore going towards its position of top dead center, which will be reached before the eccentric 44 arrives on its turn at this position of top dead center.

Figure 3:
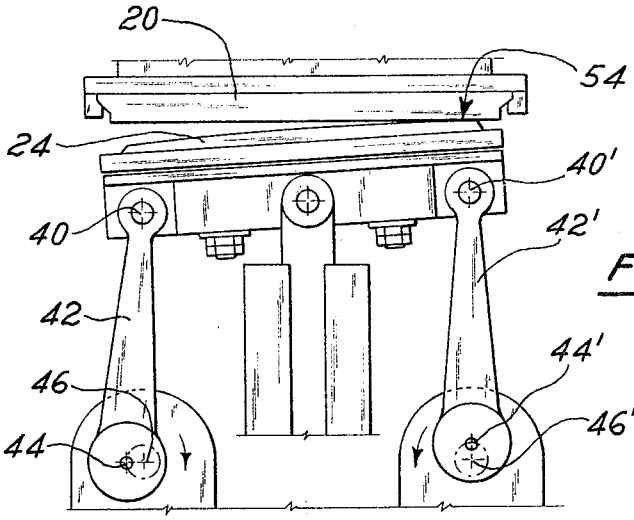

Going on with the rotation of pivots 46, 46' and therefore of eccentrics 44, 44', it can be seen in FIG. 3 that the eccentric 44' is in its position of top dead center and therefore presses the counter-punch 24 on the punch 20 in order to die-cut the material 52 in correspondence with the position, indicated by 54 in FIG. 3, of alignment with connecting rod 42'. On the contrary, the eccentric 44 is still far from its position of top dead center and therefore, in alignment with connecting rod 42, the counter-punch 24 results to be detached from punch 20.

Still going on with the rotation of axes 46, 46', the eccentric 44' goes away from its position of top dead center while the eccentric 44 approaches to this position, consequently determining a displacement along said profiles 22 and 26 of the point or better of the line 54 of maximum stress of pressing and therefore of die-cutting on the material under work. During this shifting, the eccentrics 44, 44' will reach an intermediate position shown in FIG. 1, where the surface 26 contacts on the surface 22 at the the center line of said arch 26.

Figure 4:
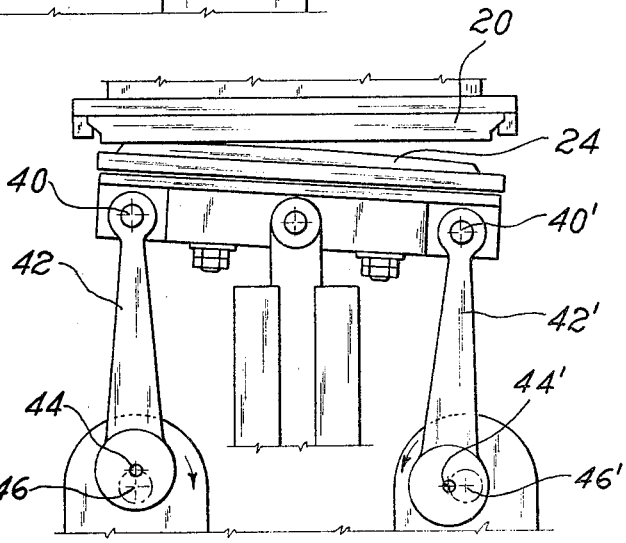

Going furtherly on with rotation, the eccentric 44' departs more and more from its position of top dead center and approaches to the position of bottom dead center, detaching from the punch 20 the zone of counter-punch aligned with the connecting rod 42', while the eccentric 44 goes to its position of top dead center, as shown in FIG. 4, determining die-cutting in correspondence with a position aligned with the relevant connecting rod 42. After that, both the eccentrics 44 and 44' approach to the position of bottom dead center to bring the machine under the conditions of FIG. 2 and then start a new cycle.

What has been said clearly shows that the control of the rolling movements of the surface 26 on the surface 22 is carried out with particularly simple and efficient means, which allow, with a single motor, undersized as compared to those of the traditional plane hollow punch, to perform automatically and in succession all the required movements of reciprocal departing and approach between punch and counter-punch and of pressing the counter-punch onto the punch to carry out the die-cutting.

Figure 5:
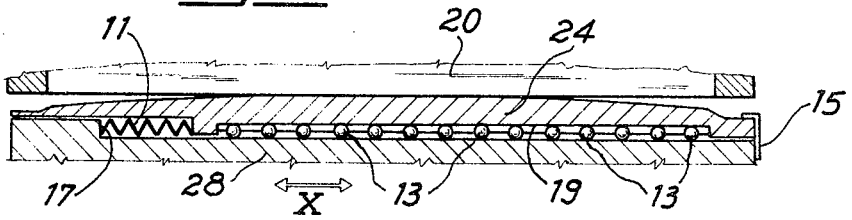
FIG. 5 is a partial section of the counter-punch, showing an embodiment thereof.

In order to ensure in any case that the counter-punch does not perform sliding movements with respect to the punch during the working cycle, the configuration of FIG. 5 has been studied, in which the counter-punch 24 is mounted on its support 28 by means of a series of rollers 13, with axis parallel to the die-cutting line, which are housed in a seat 19 of the counter-punch and allow free movements of the latter in the direction $\overline{X}$ generally parallel to the die-cutting line. One or more springs housed in a seat 17 push the counter-punch against an end stop 15 placed on the right in the drawing. By this configuration, in case the practical embodiment of the control means of the counter-punch is such as not to always ensure (for instance because of plays, wear or other) a perfect rolling of the profile of the counter-punch, this drawback is eliminated with the possibilities of displacement given by the described assembly. In this case, one has the warranty of a perfect trajectory because the possible differences between the ideal trajectory of the counter-punch and the trajectory imposed by the control means, are compensated by shiftings towards the direction $\overline{X}$ performed by the counter-punch under the friction work between it and the material under work.

Of course, the above described principles of the invention will be possibly applied in practice by those skilled in the art and several modifications might be introduced to the described and represented embodiment without departing from the spirit and scope of the invention.

I claim:

1. A die-cutting maching for die-cutting laminar material, comprising a first punch member having an external surface which is provided with cutting means for die-cutting, said cutting means having a substantially linear profile; a second punch member having an external surface which has a substantially arcuate profile; moving means for reciprocally moving said second punch member relative to said first punch member between a first position in which said first and second punch members are spaced apart to permit the introduction therebetween of a sheet of material to be die-cut and a second position in which said first and second punch members engage each other to die-cut sheet material inserted therebetween and for rocking said second punch member relative to said first punch member such that said external surface of said second punch member rolls on said external surface of said first punch member when said first and second punch members are in said second position, whereby said first and second punch members cooperate to progressively cut sheet material inserted therebetween; and mounting means for mounting said second punch member on said moving means, said mounting means including a frame attached to said moving means and urging means interposed between said frame and said second punch member for resiliently urging said second punch member away from said frame and towards said first punch member.

2. A die-cutting machine according to claim 1, further comprising guiding means for guiding said second punch member so as to prevent said second punch member from moving laterally during its movement by said moving means, said guiding means including a guide positioned on a side of said second punch member opposite from said external surface thereof and a slide attached to said second punch member and slideably received in said guide.

3. A die-cutting machine according to claim 1 or 2, wherein said moving means includes a pair of connecting rod-crank units, one unit being attached to a first pivot point at one side of said frame and the other unit being attached to a second pivot point at an opposite side of said frame.

4. A die-cutting machine according to claim 3, wherein each connecting rod-crank unit includes an eccentric adapted to rotate about an axis with adjustable eccentricity.

5. A die-cutting machine according to claim 3, wherein each connecting rod-crank unit includes a crank, one crank being rotatable in a first angular direction and the other crank being rotatable in a second angular direction opposite to said first direction, said cranks rotating at the same speed with a reciprocal angular offset depending upon the width of the arc traced by said second punch member and by the radius of said cranks.

6. A die-cutting machine according to claim 5, wherein at least one of said cranks is at or near a top dead center position when said first and second punch members are in said second position and both of said cranks are at or near a bottom dead center position when said first and second punch members are in said first position.

7. A die-cutting machine according to claim 1, wherein said mounting means includes sliding means for sliding said second punch member back and forth on said frame, said sliding means including a stop at one side of said frame and biasing means for resiliently biasing said second punch member towards said stop.

* * * * *